US006311594B1

(12) United States Patent
Ootsuka

(10) Patent No.: US 6,311,594 B1
(45) Date of Patent: Nov. 6, 2001

(54) PUNCH GUIDING APPARATUS AND STRIPPER PLATE USED THEREFOR

(75) Inventor: Yasuyuki Ootsuka, Kanagawa (JP)

(73) Assignee: Amada Company, Limited, Kanagawa-Ken (JP)

( * ) Notice: Subject to any disclaimer, the term of this patent is extended or adjusted under 35 U.S.C. 154(b) by 0 days.

(21) Appl. No.: 09/221,150

(22) Filed: Dec. 28, 1998

Related U.S. Application Data

(63) Continuation-in-part of application No. 08/886,444, filed on Jul. 1, 1997, now Pat. No. 6,152,005.

(30) Foreign Application Priority Data

Jul. 3, 1996 (JP) ..... 8-173816
Aug. 4, 1998 (JP) ..... 10-220783

(51) Int. Cl.[7] ..... B26D 7/06
(52) U.S. Cl. ..... 83/138; 83/139; 83/684; 83/686; 83/698.91
(58) Field of Search ..... 33/138, 139, 140, 33/143, 684, 685, 686, 698.81

(56) References Cited

U.S. PATENT DOCUMENTS 4,261,237 * 4/1981 DiDonato, Jr. et al. ..... 83/139
4,446,767 * 5/1984 Wilson ..... 83/136
5,056,392 * 10/1991 Johnson et al. ..... 83/140
5,081,891 * 1/1992 Johnson et al. ..... 83/140
5,127,293 * 7/1992 Chatham ..... 83/136
5,176,057 * 1/1993 Chun et al. ..... 83/139
5,271,303 * 12/1993 Chatham ..... 83/136
5,301,580 * 4/1994 Rosene et al. ..... 83/136
5,438,897 * 8/1995 Chun ..... 83/698.91 X
5,553,523 * 9/1996 Saito ..... 83/136
5,701,790 * 12/1997 Saito ..... 83/140
5,839,341 * 11/1998 Johnson et al. ..... 83/698.91 X

FOREIGN PATENT DOCUMENTS 1 249 326 10/1971 (GB) .
1251843 * 11/1971 (GB) ..... 83/140

* cited by examiner

*Primary Examiner*—M. Rachuba
(74) *Attorney, Agent, or Firm*—Blank Rome Comisky & McCauley, LLP

(57) ABSTRACT

A punch guiding apparatus includes: a cylindrical punch guide to be vertically movably supported into a punch holder; a stripper plate is detachably mounted to a forward end portion of the cylindrical punch guide; and a ring-shaped fixture. In the construction, the fixture has a ring shape that both ends are brought into contact with or close to each other. Furthermore, the fixture has a non-circular shape in which it has a plurality of elastically deformed portions which are urged and come in contact with an inner peripheral surface of the punch guide so as to be enlarged.

2 Claims, 10 Drawing Sheets

PUNCH GUIDING APPARATUS AND STRIPPER PLATE USED THEREFOR

RELATED APPLICATION

This application is a continuation-in-part of application Ser. No. 08/886,444, filed Jul. 1, 1997, U.S. Pat. No. 6,152,005 the disclosure of which is incorporated herein by reference.

BACKGROUND OF THE INVENTION

1. Field of the Invention

The present invention relates to a punch guiding apparatus which composes a portion of a punch metal mold to be used for punch press and relates to a stripper plate to be used therefor, further relates to a method of punching a punch guide hole in a blank holder of a punch assembly which is used in a state of being attached to a punch holder in a punch press such as a turret punch press, a punch assembly and a blank holder.

2. Description of the Related Art

A punch assembly in the related art has disclosed the construction that it comprises a punch body having a punching portion at its lower end portion being vertically movably housed in a punch guide which is vertically movably supported onto a turret-like punch holder of a turret punch press, and a plastic blank holder being removably fitted into a fitting groove formed in a lower end portion of the punch guide.

In the aforesaid related art, a cylindrical projecting portion of the blank holder is fitted into the fitting groove of the punch guide, and thereafter, the punch body is inserted into the punch guide. And then, the punching portion of the punch body is subjected to punching so as to punch a punch guide hole in the blank holder.

More specifically, according to the related art, in the case where the blank holder is attached to the punch guide, there is a need of previously removing the punch body from the punch guide so that the punching portion does not become obstructive. For this reason, there has arisen a problem that an attachment of the blank holder is considerably troublesome.

Moreover, in the case where the plastic blank holder is replaced with a new blank holder due to a deterioration or damage caused therein, there has arisen a problem that it is very difficult to remove the blank holder from the punch guide because the blank holder is fixedly fitted so as not to come off therefrom due to vibration, etc.

In the related art construction, in the case where the blank holder is made of a rigid plastic, there is a problem that a great pressing force is required when the blank holder is fitted into the groove of the punch guide. As the case may be, there has arisen a problem that an annular stopper convex portion which projects from an outer peripheral face of the projecting portion is chipped off therefrom.

Furthermore, in the case where the blank holder is made of a relatively soft material, there is a problem that the blank holder does not act and not exhibit its function and is lack of durability.

SUMMARY OF THE INVENTION

The present invention has been achieved with such points in mind.

It therefore is an object of the present invention to provide a punch guiding apparatus and a stripper plate to be used therefor which improve the durability when the stripper plate is mounted to and detached from a punch guide and strengthen a mounting force of the stripper plate.

It is another object of the present invention to provide a punch assembly in which removal of the blank holder can be readily achieved.

It is still another object of the present invention to provide a blank holder which can be readily fitted into the groove formed in the punch guide.

It is further object of the present invention to provide a method of punching a punch guide hole in a blank holder in which attachment of the blank holder to the punch guide and punching of the punch guide hole of the blank holder can be readily achieved.

To achieve the object, according to a first aspect of the present invention, there is provided a method of punching a punch guide hole in a blank holder while attaching the blank holder to a lower end portion of a punch guide in a punch assembly constructed in a manner that a punch body having a punching portion at its lower end portion is vertically movably housed in the punch guide vertically movably supported onto a punch holder, comprising the steps of: fitting lightly a distal end portion of a cylindrical projecting portion of the blank holder into a fitting groove formed in the lower end portion of the punch guide so that the distal end portion is momentarily held in the blank holder; and fitting forcedly the projecting portion of the blank holder into the fitting groove formed in the punch guide and punching the punch guide hole in the blank holder by pressing a punch head of a punch body of the punch assembly so that the punch guide descends and presses the blank holder against a die provided opposite to the blank holder.

Thus, the blank holder is fitted into the fitting groove by taking use of a downward pressing force of a striker, etc., so that attachment of the blank holder to the punch guide and punching of the punch guide hole of the blank holder can be readily achieved.

According to a second aspect of the present invention, there is provided a punch assembly, comprising: a punch guide vertically movably supported onto a punch holder; a punch body having a punching portion at its lower end portion vertically movably housed in the punch guide; and a blank holder is removably fitted into a fitting groove formed in a lower end portion of the punch guide, wherein the punch guide or the blank holder being formed with an inclined plane constructed so that a distance between the punch guide and the blank holder is widened toward the outside thereof, at part of an outer peripheral face on a lower end portion of the punch guide or part of an upper face of a flange of the blank holder.

With the above construction, by forcing pawls of a removal tool to bite into the inclined plane so as to abut against the inclined plane, a component in a direction of removing the blank holder from the punch guide acts thereon, so that the removal of the blank holder can be readily achieved.

According to a third aspect of the present invention, as it depends from the second aspect, wherein the inclined plane is formed on the outer peripheral face on a lower end portion of the punch guide or on the upper face of the flange of the blank holder so as to gradually guide the pawls of the removal tool between the lower end portion of the punch guide and the flange of the blank holder.

Thus, a component in a direction of removing the blank holder from the punch guide acts thereon, so that the removal of the blank holder can be readily achieved, as described above.

According to a fourth aspect of the present invention, as it depends from the second or third aspect, the punch assembly further comprises an elastic member is interposed between the punch guide and the blank holder, wherein the blank holder is retained onto the punch guide by means of the elastic member.

Thus, attachment of the blank holder to the punch guide can be readily achieved regardless of material quality of the blank holder. Also, there is no problem such that protrusions of the blank holder is not chipped off when attaching the blank holder to the punch guide.

According to a fifth aspect of the present invention, as it depends from the second, third or fourth aspect, wherein the blank holder is made of a rigid resin or metal, and the lower end face of the punch guide and the flange of the blank holder face each other.

Thus, the blank holder sufficiently acts or exhibits its function in operating.

According to a sixth aspect of the present invention, as it depends from the second, third, fourth or fifth aspect, wherein the flange of the blank holder has a thickness thicker than a bottom portion on an inside of the projecting portion formed on the blank holder.

Thus, the projecting portion of the blank holder is securely fitted into a fitting groove formed in the punch guide while punching of a punch guide hole being carried out. Therefore, the punch guide hole can be accurately punched in the blank holder.

According to a seventh aspect of the present invention, there is provided a blank holder attached to a lower end portion of a punch guide of a punch assembly, comprising: a blank holder being formed with a fitting projecting portion being capable of fitting into a fitting groove formed in the lower end portion of the punch guide; and an elastic member at an outer peripheral face of the projecting portion being capable of fitting into a stopper concave portion having an inner circumferential groove formed in the punch guide.

Thus, the blank holder can be readily fitted into the groove formed in the punch guide.

According to a eighth aspect of the present invention, as it depends from the seventh aspect, the blank holder further comprises a flange on the outside of the projecting portion formed so as to have a thickness thicker than the bottom portion on the inner side of the projecting portion.

Thus, when attaching the blank holder to the punch guide while punching a punch guide hole in the blank holder, the punch guide hole can be accurately punched in the blank holder.

According to a ninth aspect of the present invention, as it depends from the seventh or eighth aspect, wherein the flange is at least symmetrically formed with an inclined plane at its upper face.

Thus, when removing the blank holder(in other wards, removing the striper plate) from the punch guide, the removal of the blank holder can be readily achieved.

According to a tenth aspect of the present invention, there is provided a punch guiding apparatus which is constituted so that a stripper plate is detachably mounted to a forward end portion of a cylindrical punch guide via a ring-shaped fixture, wherein the fixture has a ring shape that both ends are brought into contact with or close to each other; and the fixture has a non-circular shape in which it has a plurality of elastically deformed portions which are urged and come in contact with an inner peripheral surface of the punch guide so as to be enlarged.

Therefore, the stripper plate is detachably mounted to the punch guide via the fixture. Since the fixture has a ring shape in which its both ends are brought into contact with or close to each other and has the non-circular elastically deformed portions in plural positions, when the stripper plate is mounted to the punch guide, the elastically deformed portions are enlarged so as to be urged and brought into contact with the punch guide. As a result, durability is improved, and the mounting force is strengthened.

According to an eleventh aspect of the present invention, as it depends from the tenth aspect, the fixture of the punch guiding apparatus is made of a round bar material.

Therefore, by producing the fixture using the round bar material, it can be inserted into the punch guide easily.

According to a twelfth aspect of the present invention, there is provided a stripper plate which is detachably mounted to a forward end portion of a punch guide, wherein a non-circular fixture whose one portion is cut is provided in a peripheral groove formed on an outer peripheral surface of the mounting portion to the punch guide.

Therefore, the non-circular fixture whose one portion is cut is inserted into the peripheral groove formed on the outer peripheral surface of the mounting portion to the punch guide, and the stripper plate is mounted to the punch guide. Then, since the fixture has the non-circular shape, the mounting force is strengthened and the durability is improved.

According to a thirteenth aspect of the present invention, as it depends from the twelfth aspect, there is provided the punch guiding apparatus, wherein the fixture has portions whose curvature is different in plural positions.

Therefore, since the fixture has the portions whose curvature is different in plural positions, the fixture is enlarged at the plural positions so as to be urged and brought into contact with the punch guide. As a result, the mounting force is further strengthened.

According to a fourteenth aspect of the present invention, as it depends from the twelfth aspect or the thirteenth aspect, there is provided the punch guiding apparatus, wherein the fixture is made of a round bar material.

Therefore, by producing the fixture using the round bar material, it can be inserted into the punch guide easily.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
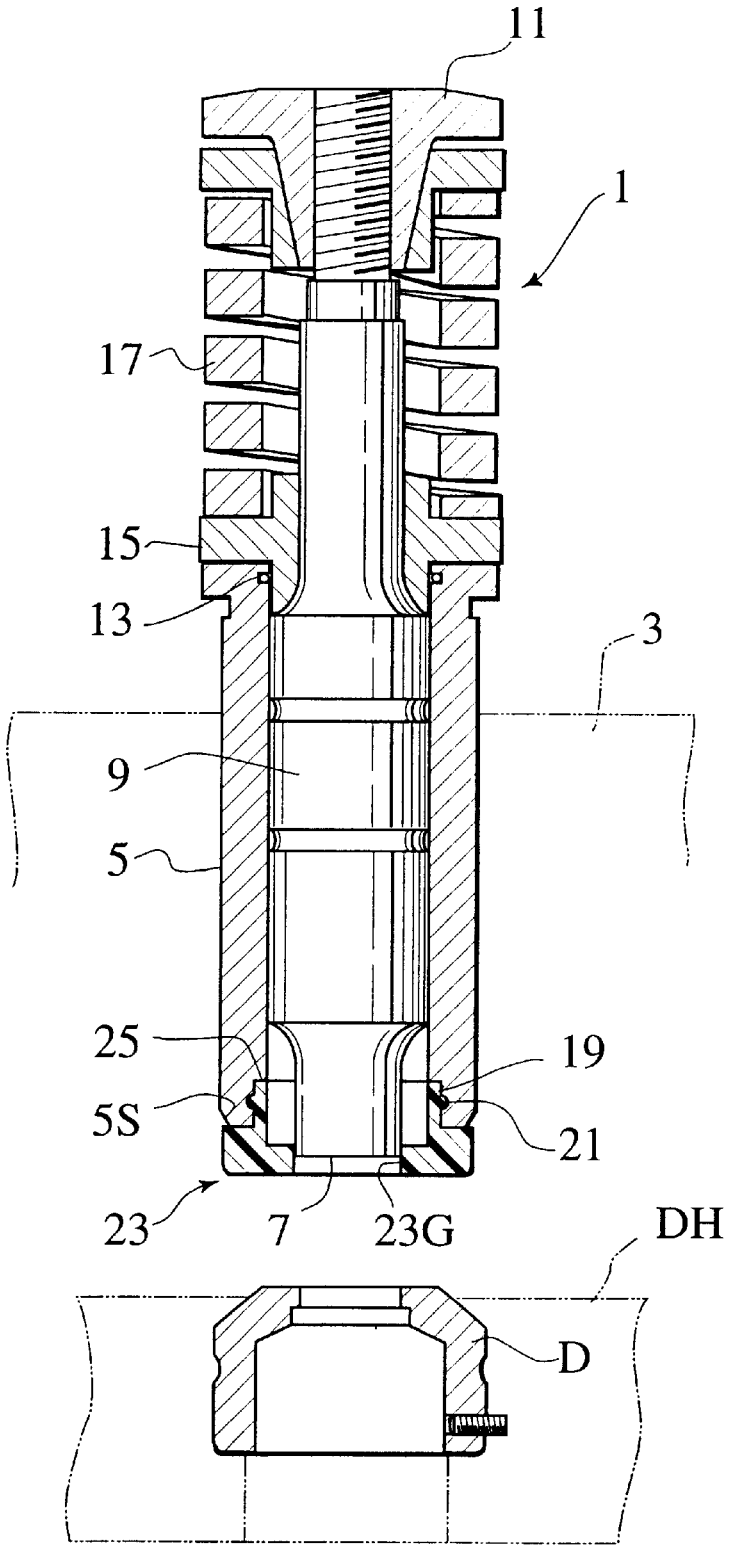
FIG. 1 is a cross sectional view of a punch assembly of the present invention.

There will be detailed below the preferred embodiments of the present invention with reference to the accompanying drawings. Like members are designated by like reference characters.

Referring now to FIG. 1, a punch assembly 1 of the present invention is provided with a cylindrical punch guide 5 which is vertically movably supported onto a turret-like punch holder 3 of a punch press, for example, a turret punch press. As being already known, the punch guide 5 is supported onto the punch holder by means of a lifter spring (not shown) so as to be situated at a predetermined height, and descends against a force by the lifter spring.

A punch body 9 having a punching portion 7 at its lower end portion is vertically movably housed in the punch guide 5. A stripper spring 17 is elastically interposed between a punch head 11 which is screwed into an upper end portion of the punch body 9 and a retainer collar 15 which is removably attached onto an upper portion of the punch guide 5 via a O ring 13.

The aforesaid punch guide 5 is provided with a fitting groove 19 at its lower end portion. An inner peripheral face of the fitting groove 19 is formed with an inner circumferential groove 21 which is one example as a stopper concave portion. The fitting groove 19 is removably fitted with a cylindrical projecting portion 25 of a blank holder 23.

Figure 2:
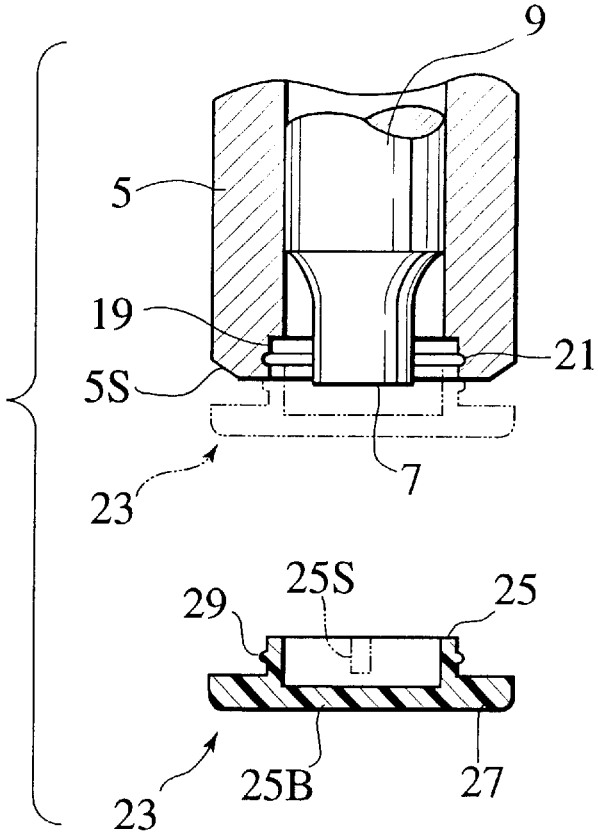
FIG. 2 is an explanatory view of an operation for attaching a blank holder onto a punch guide.

The blank holder 23 is made of a synthetic resin or proper metal. As shown in FIG. 2, the blank holder 23 has a disc-like flange 27 and the aforesaid projecting portion 25 which projects from the flange 27. An outer peripheral face of the projecting portion 25 is formed with an annular protrusion 29 which is one example as a stopper convex portion capable of engaging with the inner circumferential groove 21 formed in the punch guide 5.

A bottom portion 25B on the inner side of the projecting portion 25 is formed so as to have a thickness thinner than a thickness of the outer-side flange 27 of the projecting portion 25. Preferably, the projecting portion 25 is provided with proper slits 25S in number so that the projecting portion 25 is easy to be elastically deformed when fitting the projecting portion 25 of the blank holder 23 into the fitting groove 19 of the punch guide 5.

Further, in order to facilitate fitting the projecting portion 25 of the blank holder 23 into the fitting groove 19, preferably, the lower end portion of the groove 19 and the peripheral edge on an upper portion of the projecting portion 25 are subjected to chamfering so as to form a taper guide face therein.

Furthermore, in order to facilitate a removal of the blank holder 23 fixedly fitted into the fitting groove 19 of the punch guide 5, opposite sides of the lower end portion of punch guide 5 are symmetrically formed with an inclined plane 5S so that a distance between the blank holder 23 and the punch guide 5 becomes wider toward the outside thereof. Also, if the inclined plane 5S is formed over the entire circumstance of the punch guide 5, there is formed a conical taper face.

Now, in the case where the projecting portion 25 of the blank holder 23 is fitted into the groove 19 of the punch guide 5, a distal end portion of the projecting portion 25 of the blank holder 25 is lightly fitted into the groove 19 as shown by the two dotted line of FIG. 2 in a state that the punch body is housed in the punch guide 5. And then, the blank holder 23 is temporarily held onto the punch guide 5.

Figure 3:
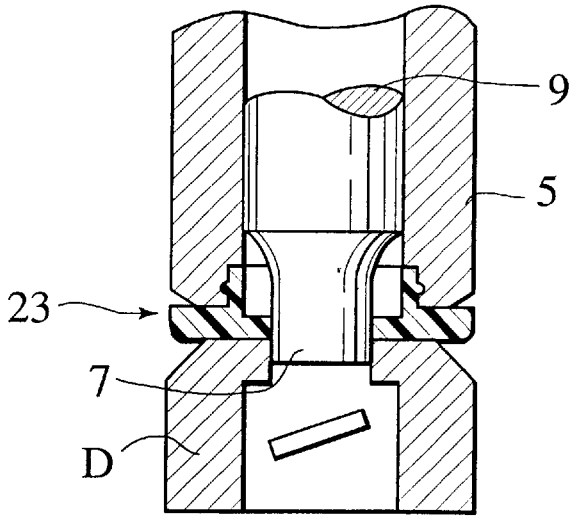
FIG. 3 is an explanatory view of an operation for punching a punch guide hole in the blank holder together with the blank holder attachment.
Figure 4:
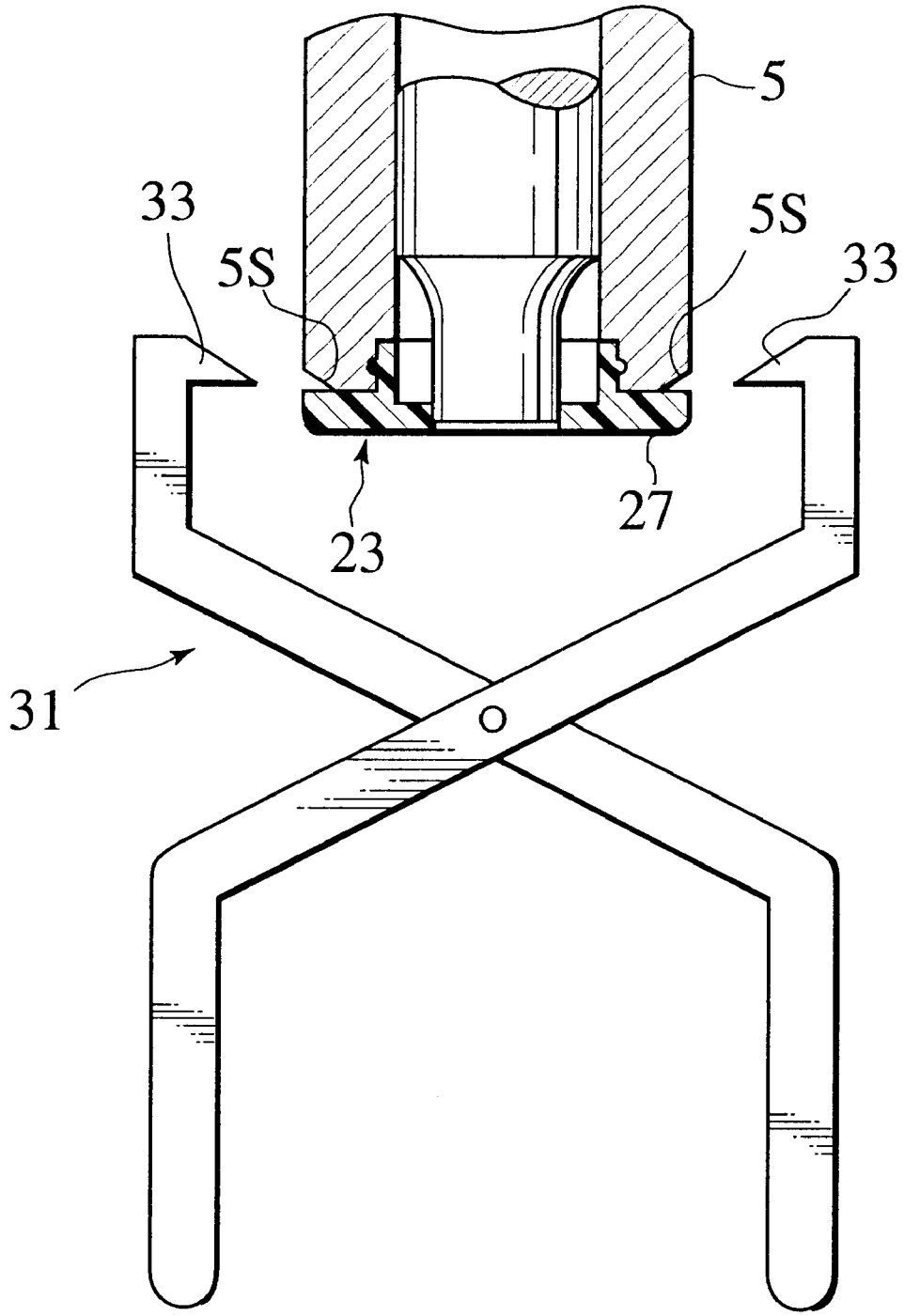
FIG. 4 is an explanatory view of an operation for removing the blank holder from the punch guide.

Thereafter, by taking use of a pressing force by a ram, striker or the like in the punch press, the punch head 11 is pressed down by means of the ram, striker or the like so that the punch body 9 descends, and simultaneously, the punch guide 5 descends together with the punch body 9 against a force of the lifter spring (not shown). Successively, when the blank holder 23 is pressed against a die D which is attached onto a die holder DH provided opposite to the punch assembly 1, the projecting portion 25 of the blank holder 23 is forcedly fitted into the groove 19 of the punch guide 5 while a punch guide hole 23G being punched in the blank holder 23 by punching of the aforesaid punching portion 7 (see FIGS. 1 and 3).

In this case, since the flange 27 is formed thicker than the thickness of the bottom portion 25B on the inner side of the projecting portion 25 of the blank holder 23, the projecting portion 25 is securely fitted into the groove 19, and punching of the punch guide hole 23G is carried out in a state that the flange 27 is sandwiched in between the die D and the lower end portion of the punch guide 5.

In the manner as described above, the blank holder 23 has been used for a long time in a state that the projecting portion 25 of the blank holder 23 is fitted into the groove 19 of the punch guide 5. Thereafter, in the case where the using blank holder 23 is replaced with a new blank holder due to a deterioration or damage caused therein, a pair of opening and closing pawl portions 33 provided in a removal tool 31 is interposed between the inclined plane 5S formed in the punch guide 5 and the flange 27 of the blank holder, and then, a distance between the pair of pawl portions 33 gradually makes narrow. Whereby a component in a direction of removing the blank holder 23 from the punch guide 5 acts on by an existence of the inclined plane 5S, and an engagement of an inner circumferential groove as the stopper concave portion 21 of the fitting groove 19 with the stopper convex portion 29 of the projecting portion 25 is released, so that the blank holder 23 can be readily removed from the punch guide 5.

As described above, the blank holder 23 is removed from the punch guide 5, and thereafter, a new blank holder 23 is temporarily held in the lower end portion of the punch guide 5 as described before. And then, when the aforesaid operation is repeated, the new blank holder 23 is attached with respect to the punch guide while the punch guide hole 23G being punched therein.

Figure 5:
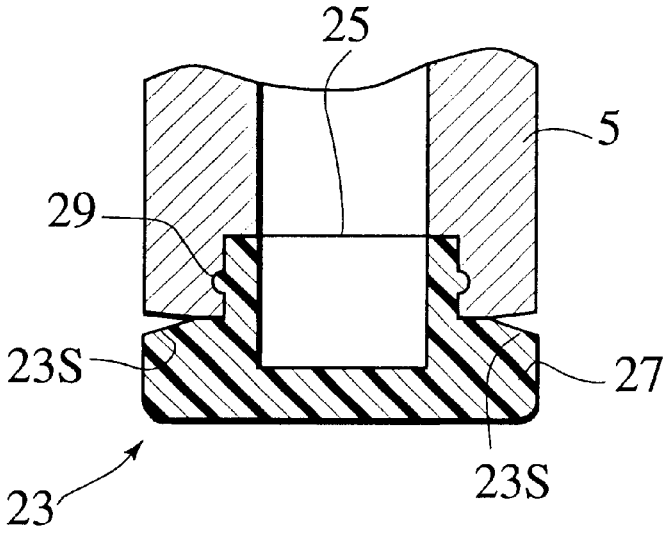
FIG. 5 is an explanatory view showing a second embodiment of the present invention.

Moreover, in order to facilitate a removal of the blank holder 23 from the punch guide 5, as shown in FIG. 5, an upper face of the flange 27 of the blank holder 23 may be formed with an inclination plane 23S instead of forming the inclined plane 5S in the lower end portion of the punch guide 5. Also, the inclined plane may be formed both in the punch guide 5 and in the blank holder 23.

Figure 6:
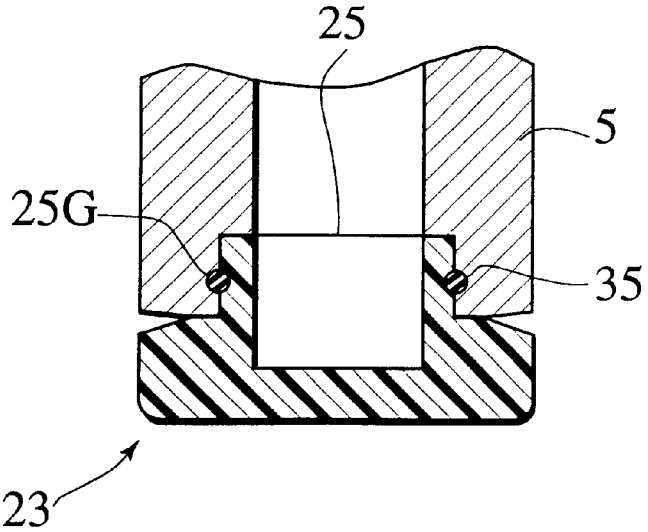
FIG. 6 is an explanatory view showing a third embodiment of the present invention.

As shown in FIG. 6, the outer peripheral face of the projecting portion of the blank holder 23 is formed with a circumferential groove 25G. The circumferential groove 25G may be provided with an elastic member such as an O ring, etc.

With the construction in which the blank holder 23 is provided with the elastic member 35 as described above, when attaching the blank holder 23 made of rigid material to the punch guide 5, the attachment of the blank holder 23 can be readily achieved even in the case where the projecting portion 25 is hard to be elastically deformed.

With aforesaid construction, the elastic member 35 exhibits a function as an annular stopper convex portion. Thus, the elastic member 35 is elastically deformed when being fitted into to the groove 19. Therefore, this serves to prevent the elastic member 35 from being chipped off by an edge portion of the groove 19.

In the construction described hereinbefore as the third embodiment referring to FIG. 6, the blank holder 23, in other wards a stripper plate is detachably mounted to a forward end portion (lower end portion) of the punch guide 5 via the elastic member 35, in other wards, an O-ring.

In the above-described punch apparatus, since the stripper plate is detachably mounted to the punch guide via the O-ring, there arose a problem that while the stripper plate is repeatedly mounted and detached, the O-ring is ripped, and the durability is not good. Moreover, the mounting force was not strong, and thus there was fear of the stripper plate slipping off.

The following fourth embodiment which will be described referring to the drawings in detail, is as an improvement of the present invention, with such a points in view.

Figure 7:
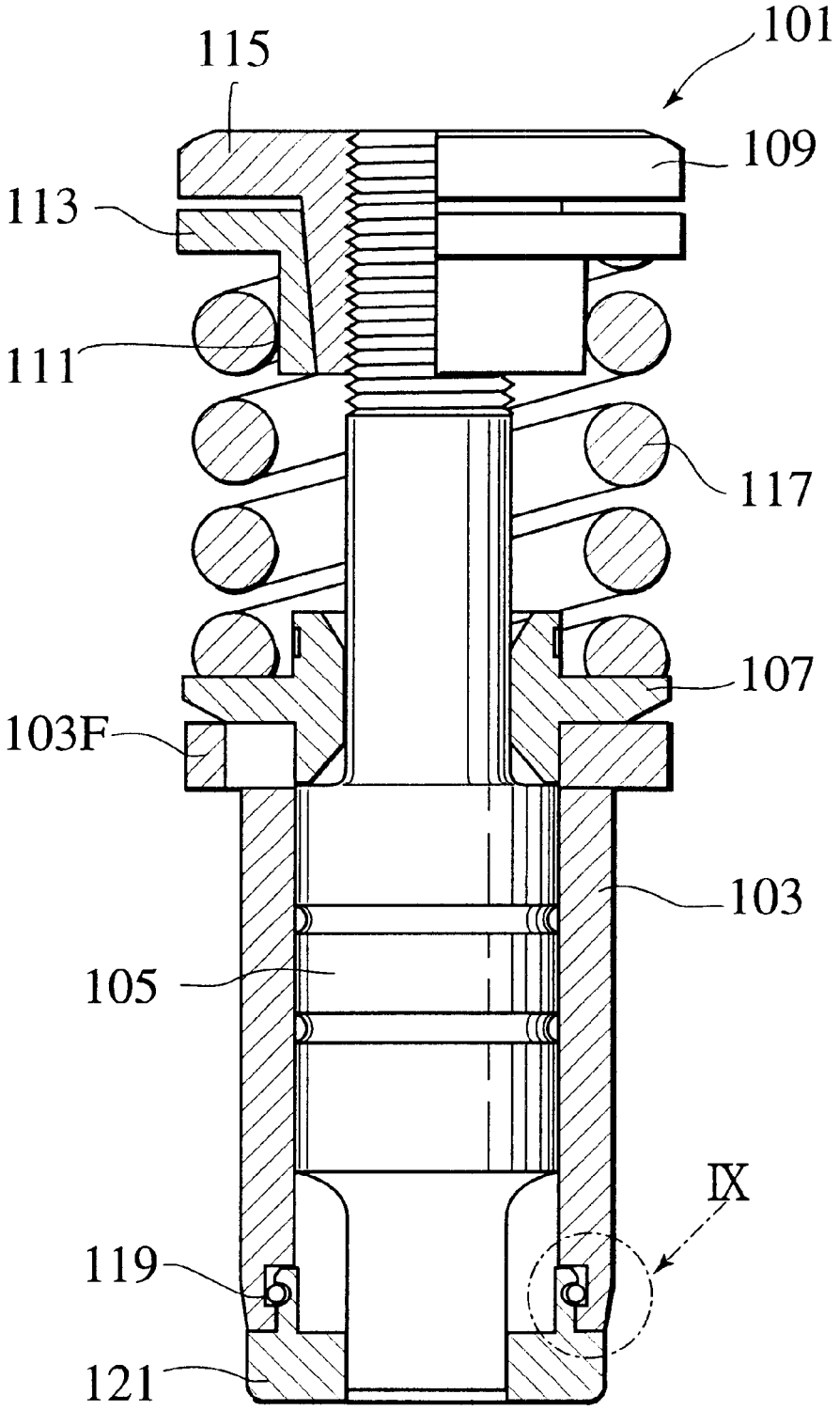
FIG. 7 is a front sectional view showing a punch apparatus according to the present invention as a fourth embodiment.

With reference to FIG. 7, in a punch press such as a turret punch press, as a punch apparatus 101 which is used for punching a work in corporation with a die, a punch body 105 is mounted to a punch guide 103. A retainer collar 107 is mounted to an upper flange 103F of the punch guide 103.

In addition, a punch head 109 is screwed into an upper end portion of the punch body 105, and a punch head fastening member 113 is engaged with a tapered portion 111 formed in an outer periphery of the punch head 9. Further, a stripper spring 117 is provided between the retainer collar 107 and the punch head 109.

A stripper plate 121 is detachably mounted to a forward end portion (lower end portion) of the punch guide 103 via a fixture 119.

Figure 8:
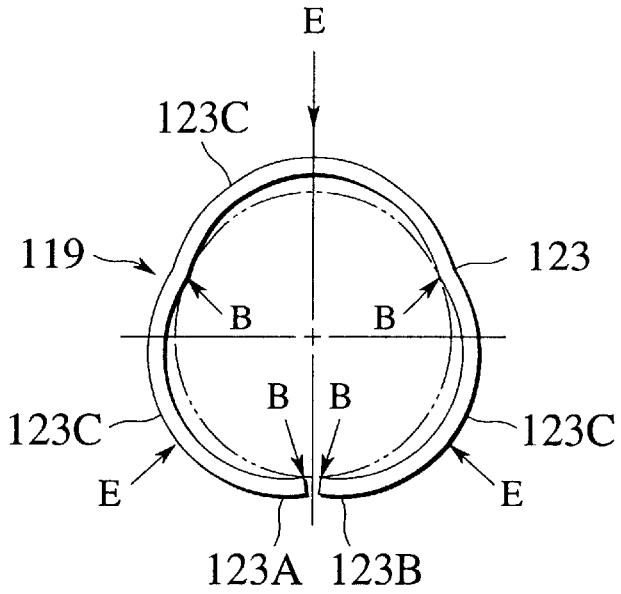
FIG. 8 shows a main section of the present invention and is a plan view of a round spring steel as a fixture.
Figure 9:
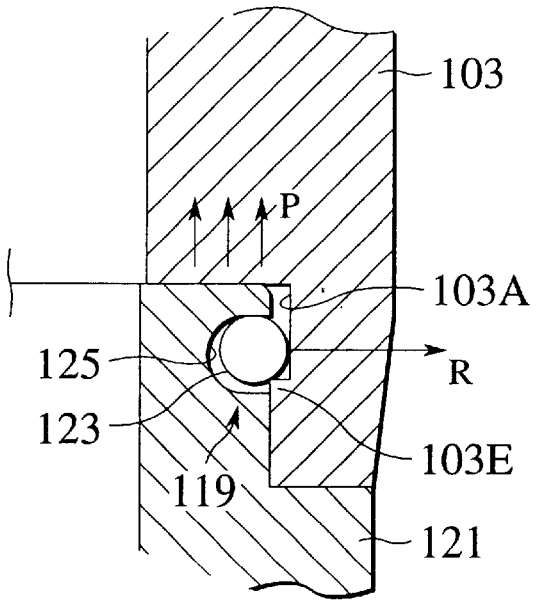
FIG. 9 is an enlarged drawing of a portion IX of FIG. 7 circled by an alternate long and short dash line.

As shown in FIG. 8 in detail, the fixture 119 is composed of a round spring steel 123 as one example of a ring-shaped round bar material which brings both end portions 123A and 123B in contact with each other or close to each other, and it is provided with elastically deformed portions 123C in plural positions, for example, three positions, so as to have a non-circular shape. Moreover, as shown in FIG. 9, the fixture 119 is fitted into a peripheral groove 125 formed in the stripper plate 121 and is urged and comes in contact with an inner peripheral groove 103A of the punch guide 103 so as to be enlarged therein. That is, since the round spring steel 123 is compressed from the outside as shown by outer arrows E while points represented by inner arrows B being used as supporting points in FIG. 8 and strong force can be secured, the mounting force can be strengthened further than a conventional way. As is illustrated in FIG. 8, the shape of the spring steel 123 includes a plurality of deformed portions which are outwardly convex in shape so as to contact the inner peripheral groove 103A of the punch guide and a plurality of supporting points (indicated by arrows B) which are inwardly convex in shape so as to contact the outer peripheral groove 125 of the stripper plate 121.

Furthermore, as shown in FIG. 9, a force which returns the round spring steel 123 to the direction of an arrow R exerts on a lower end of the peripheral groove 103A of the punch guide 103, and the round spring steel 123 comes in contact with an edge portion 103E. Moreover, when the round spring steel 123 attempts to return, the force in the direction of the arrow R exerts in a direction of an arrow P so as to press the stripper plate 121 against the punch guide 103 side.

Figure 10:
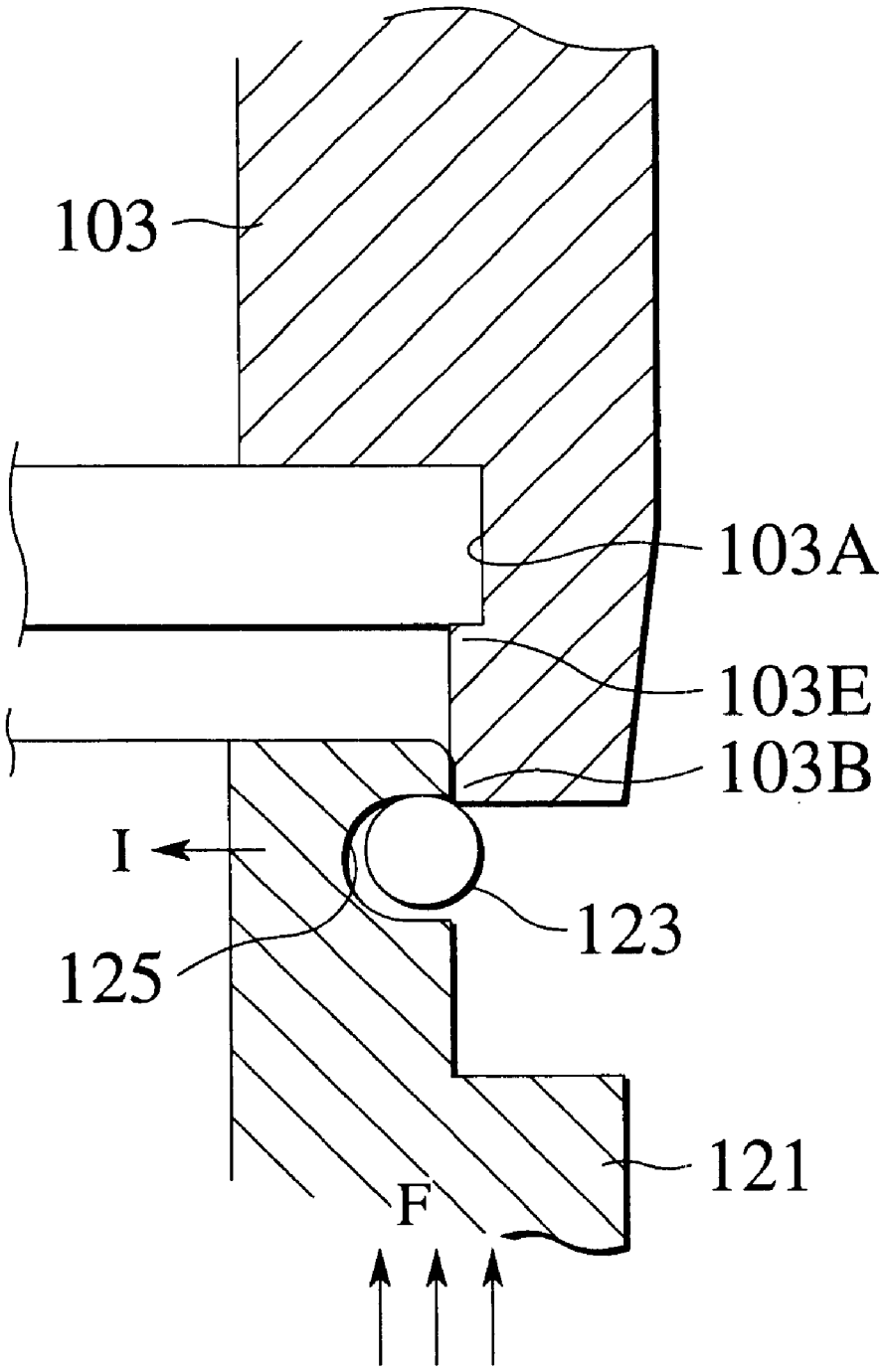
FIG. 10 is an explanatory drawing that a stripper plate is mounted to a punch guide.

In addition, as shown in FIG. 10, since the round spring steel 123 is used, when the stripper plate 121 is pressed in the direction of an arrow F, the round spring steel 123 comes in contact with a lower edge portion 103B so as to evacuate to the inside (side of an arrow I). As a result, the mounting can be carried out without requiring a special tool, and durability can be improved.

Figure 11:
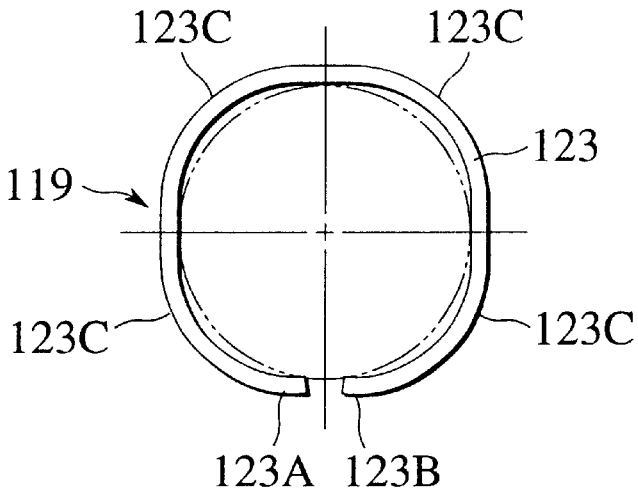
FIG. 11 is a plan view showing the round spring steel according to a fifth embodiment which substitutes for one of FIG. 8.

FIG. 11 shows another embodiment which substitutes for that shown in FIG. 8. In FIG. 11, the round spring steel 123 has a square shape and elastically deformed portions 123C are provided in four positions. Also in this case, the functions and effects, which are the same as those shown in FIG. 8, can be obtained.

Figure 12:
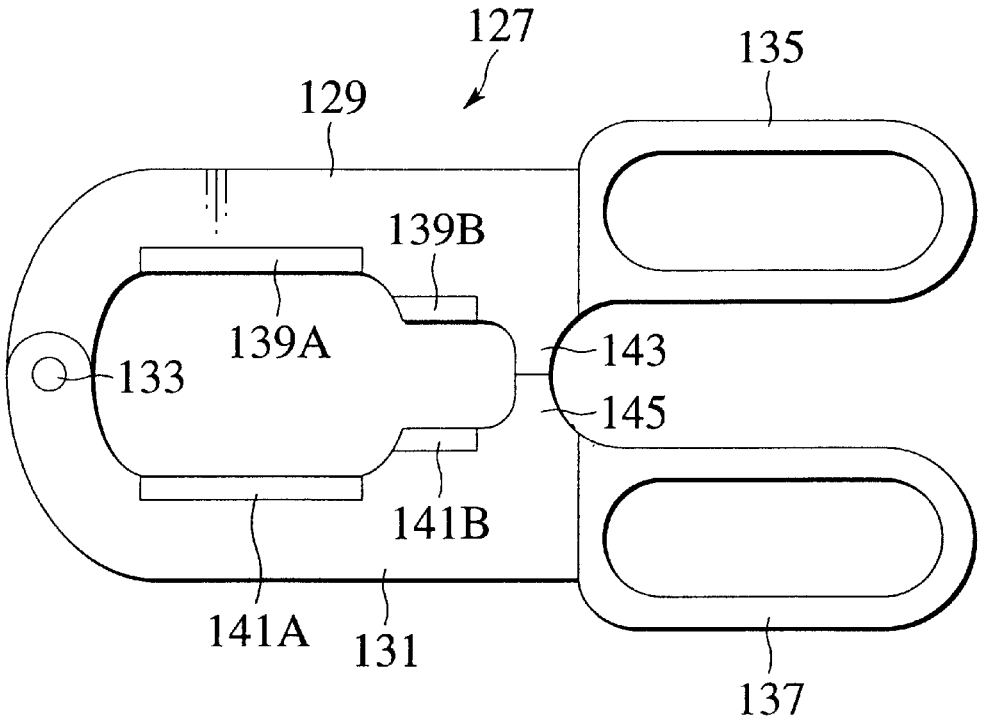
FIG. 12 is a plan view of a pryer.

FIG. 12 shows a pryer 127 which detaches the stripper plate 121 from the punch guide 103 or the punch guide 103 from the retainer collar 107. In FIG. 12, the pryer 127 has arms 129 and 131, and a forward end of the arm 129 and a forward end of the arm 131 are mounted via a pin 133 so as to be capable of pivoting. Moreover, grips 135 and 137 are provided integrally on backward end portions of the arms 129 and 131.

Edge sections 139A, 139B, 141A and 141B which are slanted towards the inside are provided in an inner portion where the arms 129 and 131 face each other. Moreover, inner portions on the backward end portions of the arms 129 and 131 serve as stoppers 143 and 145. For example, the edge sections 139A and 141A are used for 1" and ¼" punch P, and the edge sections 139B and 141B are used for ½" punch P.

According to the above structure, the arms 129 and 131 are pivoted about the pin 133, and as shown in FIG. 12, the stoppers 143 and 145 come in contact with each other so that the arms 129 and 131 are not pivoted further.

Figure 13:
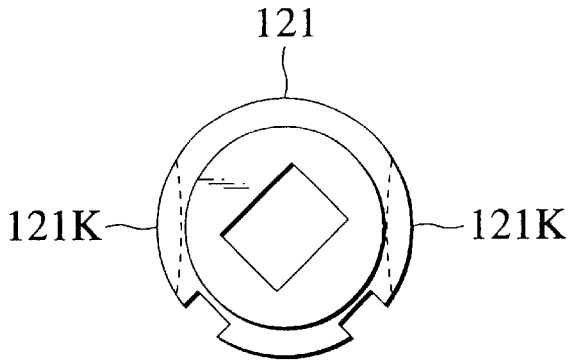
FIG. 13 is a bottom view of the stripper plate.
Figure 14:
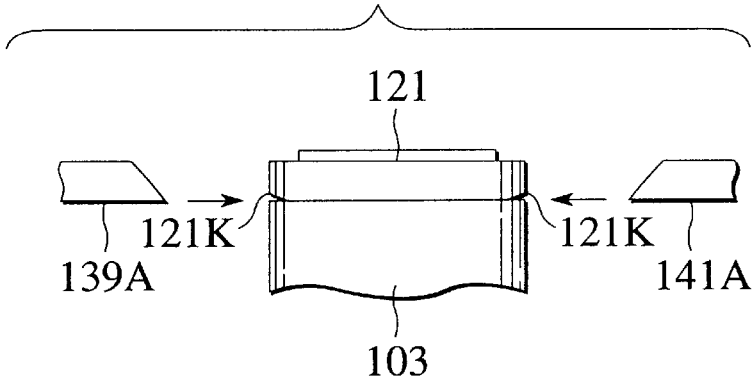
FIG. 14 is an explanatory drawing that the stripper plate is detached from the punch guide by using the pryer.
Figure 15:
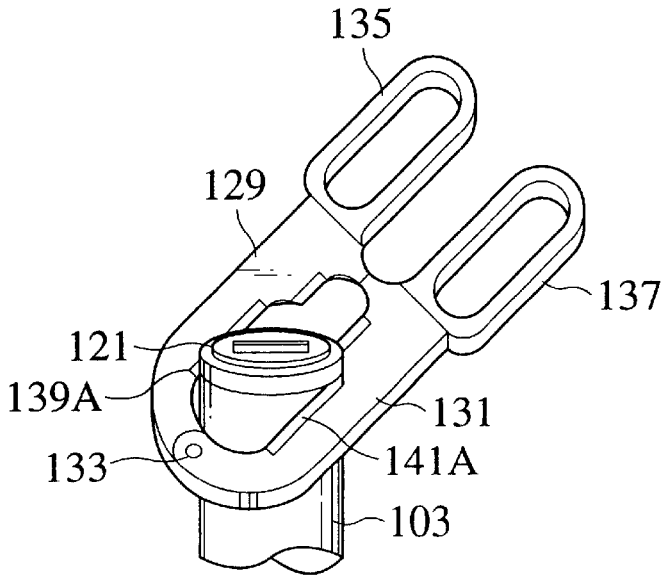
FIG. 15 is an explanatory drawing that the stripper plate is detached from the punch guide by using the pryer.

In the case where the stripper plate 121 is detached from the punch guide 103 by using the pryer 127, as shown in FIGS. 13 and 14, since a slanted portion 121K is provided in positions which face each other at the forward ends of the stripper plate 121, as represented by an arrow in FIG. 14, the edge sections 139A and 141A of the arms 129 and 131 in the pryer 127 are brought close to the respective slanted portions 121K. Moreover, as shown in FIG. 15, a hand is inserted into the grips 135 and 137 and the edge sections 139A and 141A are inserted into the slanted portions 121K of the stripper plate 121. Then, the grips 135 and 137 of the pryer 127 are lifted up so that the stripper plate 121 can be detached easily from the punch guide 103.

Figure 16:
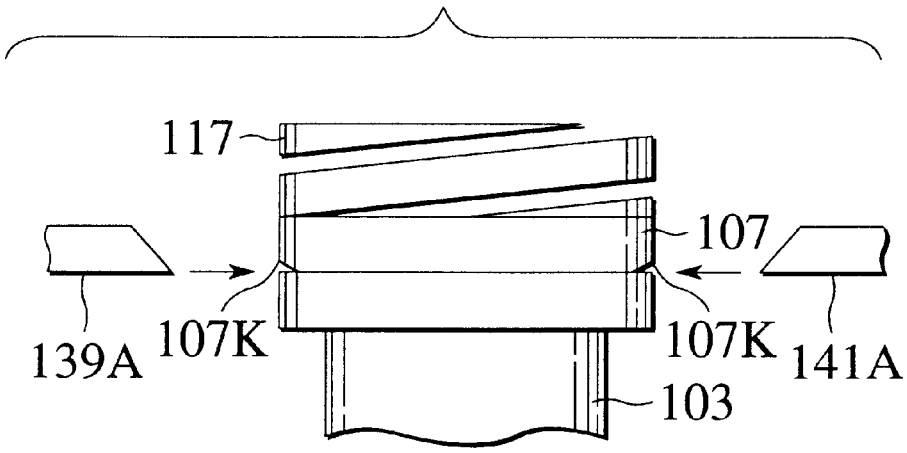
FIG. 16 is an explanatory drawing that the punch guide is detached from a retainer collar by using the pryer.
Figure 17:
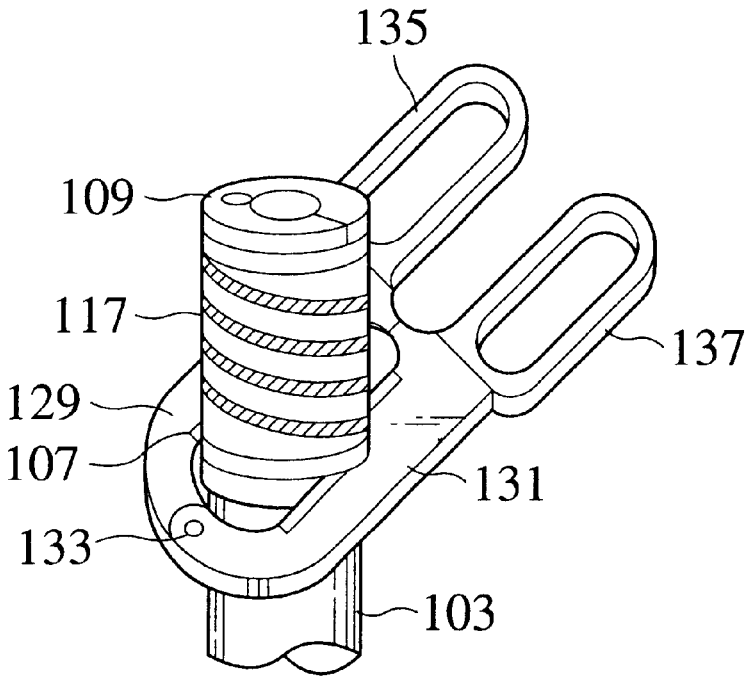
FIG. 17 is an explanatory drawing that the punch guide is detached from the retainer collar by using the pryer.

In addition, in the case where the punch guide 103 is detached from the retainer collar 107 by using the pryer 127, as shown in FIG. 16, since slanted portions 107K are provided in positions at the lower end of the retainer 107 which face each other, as represented by an arrow in FIG. 15, the edge sections 139A and 141A of the arms 129 and 131 of the pryer 127 are brought close to the respective slated portions 107K. Moreover, as shown in FIG. 17, a hand is inserted into the grips 135 and 137, and the edge portions 139A and 141A are respectively inserted into the slanted portions 107K of the retainer collar 107. Then, the grips 135 and 137 of the pryer 127 are lifted up so that the punch guide 103 can be detached easily from the retainer collar 107.

While preferred embodiments of the present invention have been described using specific terms, such description is for illustrative purposes, and it is to be understood that changes and variations may be made without departing from the spirit or scope of the following claims.

What is claimed is:

1. A punch guiding apparatus, comprising:

a cylindrical punch guide to be vertically movably supported into a punch holder, the cylindrical punch guide including an inner peripheral groove further including an edge portion;

a stripper plate being detachably mounted to a lower end portion of the cylindrical punch guide, the stripper plate comprising an outer peripheral groove; and an elastic fixture being generally ring shaped and including a plurality of deformed portions which are outwardly convex in shape so as to contact the inner peripheral groove of the punch guide, the ring-shaped fixture including closely adjacent ends and a plurality of supporting points which are inwardly convex in shape so as to contact the outer peripheral groove of the stripper plate;

wherein the fixture of the punch guiding apparatus comprises round bar material.

2. A stripper plate, to be detachably mounted to a lower end portion of a punch guide; the stripper plate comprising:

a stripper plate body to be detachably mounted to a forward end portion of a punch guide, the stripper plate including a mounting portion to be inserted into the punch guide; and an elastic fixture, being generally ring shaped, the fixture including a plurality of deformed portions which are outwardly convex in shape so as to contact an inner peripheral groove of the punch guide, the ring-shaped fixture including closely adjacent ends, the ring-shaped fixture including a plurality of supporting points which are inwardly convex in shape so as to contact an outer peripheral groove formed on the mounting portion of the stripper plate;

wherein the fixture includes three of the deformed portions, and wherein the fixture comprises round bar material.

* * * * *